United States Patent [19]

Rieder

[11] 4,077,167

[45] Mar. 7, 1978

[54] SECURITY WINDOW UNIT

[75] Inventor: Klaus Rieder, Edmonton, Canada

[73] Assignee: Pentagon Industries Ltd., Canada

[21] Appl. No.: 744,346

[22] Filed: Nov. 23, 1976

[30] Foreign Application Priority Data

Jun. 25, 1976 Canada ..... 255688

[51] Int. Cl.[2] ..... E04H 3/08

[52] U.S. Cl. ..... 52/106; 49/50; 52/404; 52/727

[58] Field of Search ..... 52/106, 456, 724, 725, 52/475, 507, 404, 727, 730; 109/2, 10, 58, 64, 1; 49/50, 61, 15, DIG. 1, 504

[56] References Cited

U.S. PATENT DOCUMENTS

| | | | |
|---|---|---|---|
| 763,651 | 6/1904 | Ziegler | 52/727 |
| 1,504,677 | 8/1924 | Carter | 52/727 |
| 1,858,512 | 5/1932 | Langenberg et al. | 52/725 |
| 2,032,693 | 3/1936 | Fries et al. | 52/106 |
| 2,125,807 | 8/1938 | Petty | 52/727 |
| 3,156,332 | 11/1964 | Cameron | 49/DIG. 1 |

FOREIGN PATENT DOCUMENTS

| | | | |
|---|---|---|---|
| 1,113,555 | 9/1961 | Germany | 52/106 |

*Primary Examiner*—J. Karl Bell

*Attorney, Agent, or Firm*—Stevens, Davis, Miller & Mosher

[57] ABSTRACT

This specification discloses a secure yet aesthetic window unit which has particular applicability to detention buildings such as prisons, jails, cell blocks, penitentiaries, asylums and similar building structures and which is, for all practical purposes, resistant to metal cutting devices. One of preferable embodiments of such a window unit comprises a first frame, a second frame having the same height and width dimensions as the first frame and being integral with the first frame, and glazing; said first frame and second frame each comprising two jambs, a sill, a head frame and at least one mullion dividing the window opening thus formed into horizontal sections of a width sufficient to prevent the passage therethrough of an adult person, being preferably not more than about 6 inches or preferably less than about 5¾ inches; said jambs, sill, head frame and each mullion being metal tubes; each mullion of the first frame being filled with concrete and each mullion of the second frame confining a rotatable steel bar therein.

25 Claims, 10 Drawing Figures

SECURITY WINDOW UNIT

This invention relates to a secure yet aesthetic window unit which has particular applicability to detention buildings such as prisons, jails, cell blocks, penitentiaries, asylums and similar building structures and which is, for all practical purposes, resistant to metal cutting devices.

The problem with secure windows so far has been the accessibility with metal cutting devices to the predominantly steel framing, screen or bar material. Steel mullions or bars are cut to provide an opening large enough for escape. Ordinary window glass is dismantled off the frame unit or simply smashed.

There have been proposed secure windows which, according to the inventors, were claimed to be free from or protected against metal cutting devices. Examples of such windows are described in Canadian Pat. No. 92,261 of Mar. 21, 1905, to Ziegler and Canadian Pat. No. 130,805 of Jan. 11, 1911, to Klett. The Ziegler patent shows a jail bar having a plurality of longitudinal circular apertures formed therethorough and located adjacent the outer surface of the bar. These apertures are filled with glass whereby the bar is said to be protected from a saw or the like. The Klett patent disclosed a jail bar comprising an outer casing, an inner round rod, bearing balls, and explosive which is arranged between the casing and the rod. The jail bar of the Klett patent would have some resistance to cutting as the inner round rod rotates if it is subjected to physical abuse such as sawing. The rotating rod, furthermore, ignites the explosive, thereby giving a warning sound to a guard.

These prior patents, while displaying resistance to metal cutting devices, nevertheless are excessively complicated and may be impractical for installation in a penal or security institution. Furthermore, the constructions of Ziegler and Klett are unsightly and to some extent are not suitable for installation in a modern institution where appearance is important.

In the design of a penal or security institution, because of the adverse psychological impact on inmates and guards of steel bars or wire mesh, it is important to avoid the use of these materials in exposed areas and to consider the aesthetics of security devices such as reinforced windows.

A primary object of the present invention resides in the provision of a secure, yet aesthetically acceptable window unit.

Another object of the invention is to provide a secure, yet aesthetically acceptable window unit which can be prefabricated at a factory and is easy to install in a wall opening.

In an aspect of the present invention, there is provided a security window unit comprising a frame comprising two jambs, a sill, a head frame and at least one mullion dividing the window opening thus formed into sections, each not more than 6 inches in width, said jambs, sill, head frame and each mullion being tubes; and each mullion of the frame confining a rotatable steel bar therein.

In another aspect of the present invention, there is provided a security window unit comprising a first frame, a matching second frame having the same height and width dimensions as the first frame and being integral with the first frame, said first frame and second frame each comprising two jambs, a sill, a head frame and at least one mullion dividing the window opening thus formed into sections, each not more than 6 inches in width, said jambs, sill, head frame and each mullion being metal tubes; each mullion of the first frame being filled with concrete and each mullion of the second frame confining a rotatable steel bar therein.

In still another aspect of this invention, there is provided a security window unit comprising a first frame, a matching second frame having the same height and width dimensions as the first frame and being integral with the first frame, and glazing, said first frame and second frame each comprising two jambs, a sill, a head frame and at least one mullion dividing the window opening thus formed into sections, each not more than 6 inches in width, said jambs, sill, head frame and each mullion being metal tubes; each mullion of the first frame being filled with concrete and each mullion of the second frame confining a rotatable steel bar therein.

In further aspects, the present invention provides a secure yet aesthetic window unit which is constructed of a broken hollow metal section for jambs, sill and head frame. The centre mullion is located in such a way to divide the clear window opening into spaces of a width sufficient to prevent the passage therethrough of an adult person. The usual largest dimension for such openings is about $5\frac{3}{4}$ inches. The mullion (or mullions) is constructed of tubular steel components welded between sill and head frame of the window unit. The outer part of the mullion, a square tube, houses a round bar which is pivoted on a pin, mounted to the bottom; thus, if the bar is subject to physical abuse such as sawing, the bar starts to rotate. To extend the duration of sawing, the bar is made of hardened and preferably heat treated tool steel (4140 steel.) The inner tube of the mullion, a rectangular tube, is filled with high strength concrete, for instance, hardened concrete containing carbide chips. Two pieces of concrete reinforcement steel bar (rebar) are placed within the concrete. The purpose of the concrete fill is to dull steel cutting devices. The purpose of the rebar within the concrete fill is to prevent shattering and disintegrating of the concrete fill in case of mullion abuse. Also, the rebar consitutes another obstacle to cut through. Surrounding frame members are not as critical as mullions in the design of a window. They are anchored into the adjacent wall members and therefore form a part of the wall. However, it is advantageous to treat at least the inner part of the frame similar to the mullions by filling it with concrete. The outside half of the frame member may be filled with rigid fiber glass or other insulation for thermal protection.

Glass stops are constructed of sheet steel in a channel like shape or solid steel bars and mounted to the window frame with countersunk fastening devices. All glass stops are assessible only from the outside of the window. The spacing of the glass stops varies according to the thickness of glass used. In this aspect of the invention two pieces of sheet glass are installed between appropriate glass stops to provide thermal insulation and added security. The glass intended for this application may be replaced by nonbreakable plastic, mounted between glass stops in glazing tapes.

In still further aspect of the present invention there is provided a mullion unit comprising a first mullion being made from a metal tube and a second mullion being integral with the first mullion in back-to-back relation, said second mullion being made from a metal tube and confining a rotatable steel bar therein.

Other objects, features and advantages of this invention will be apparent from the accompanying detailed drawings.

FIG. 1 shows a perspective view of the secure yet aesthetic window unit of the present invention. The view is taken from the outside.

FIG. 2*a* shows an elevational view of the window unit seen from the outside.

FIG. 2*b* shows an elevational view of the window unit seen from the inside.

Figure 7:
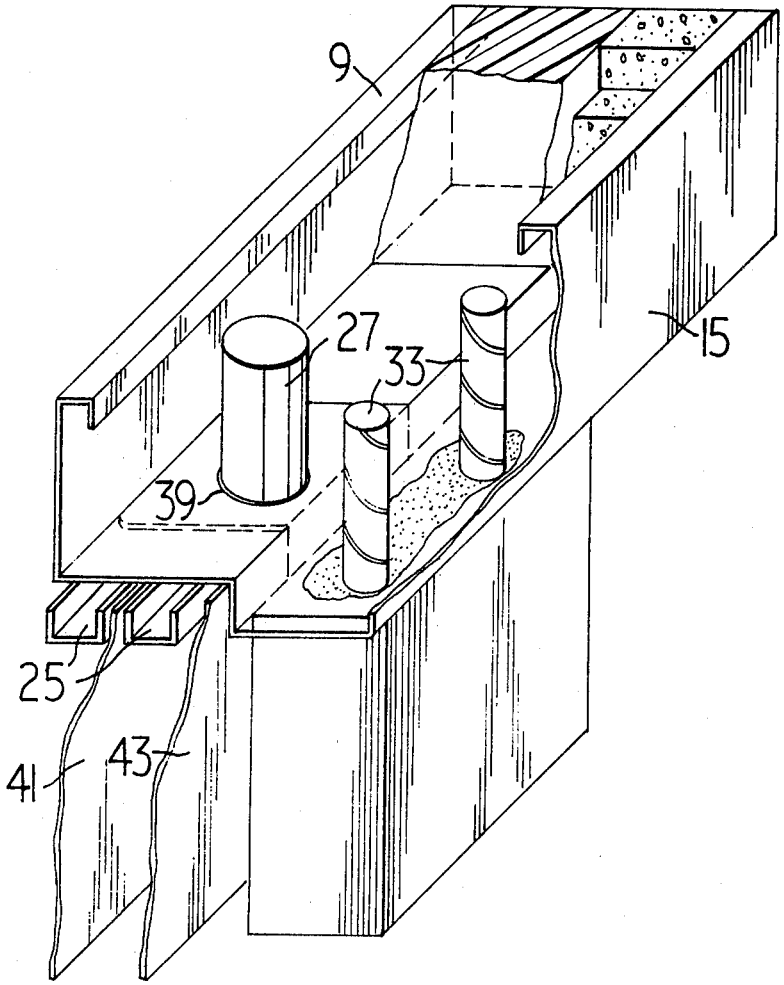
Figure 7A:
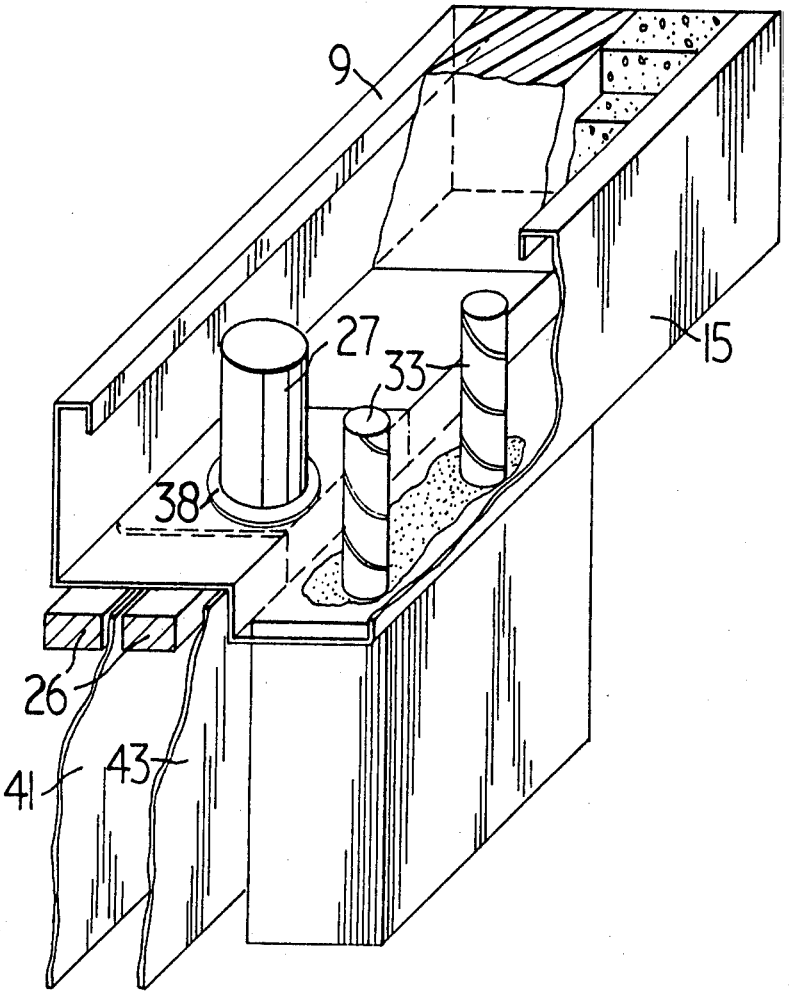

FIGS. 7 and 7*a* are fragmentary vertical sectional views of the top part of the mullion where it intersects with the head frame, in two similar embodiments. the top part of the mullion where it intersects with the head frame.

Figure 2B:
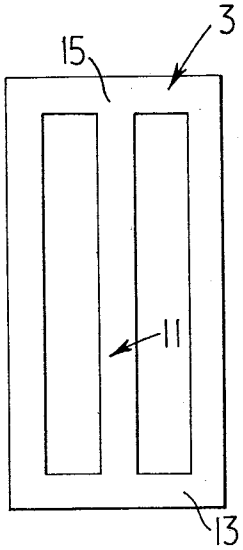
Figure 2A:
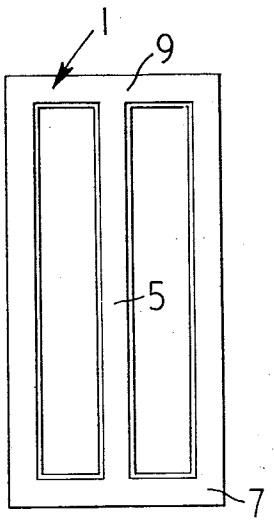
Figure 1:
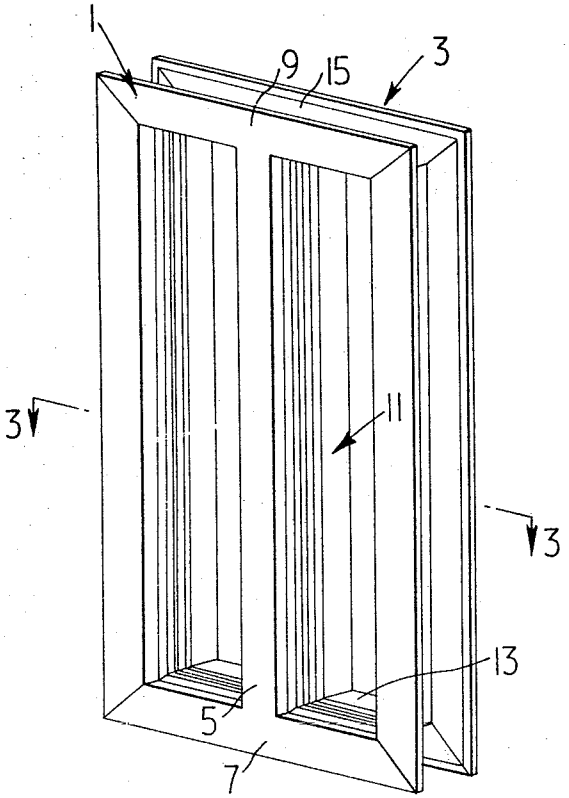

Construction of the secure yet aesthetic window unit in accordance with the present invention embraces three components, i.e., an outside frame, an inside frame, and glazing. In FIG. 1, FIG. 2*a* and FIG. 2*b* are shown the outside frame 1 and the inside frame 3. Mullion 5 of the outside frame is made from a square steel tube and welded at the both ends thereof with sill 7 and head frame 9 of the outside frame. Mullion 11 of the inside frame is also made from a rectangular steel tube and welded at the both ends thereof with sill 13 and head frame 15 of the inside frame. The outside frame and inside frame are welded to each other at the adjacent faces thereof.

Figure 3:
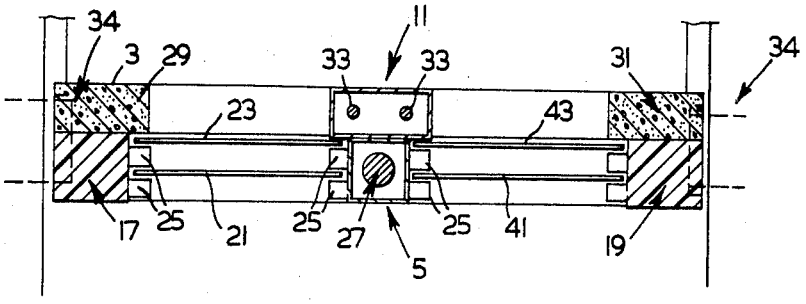
FIG. 3 shows a cross sectional view taken along the line III—III in FIG. 1.

FIG. 3 shows the construction of the secure yet aesthetic window unit of the present invention, taken at the mid height of the window unit. The outside frame 1 at the mid height thereof consists of two jambs 17, 19 filled with rigid glass fiber for thermal insulation, mullion 5 dividing the window opening into two equal spaces of about $5\frac{3}{4}$ inches in width, each of which being installed with two sheets of plastic glazing 21, 23 spaced from each other and secured between jamb 17 and mullion 5 by means of glass stops represented by numberal 25. Mullion 5 houses rotatable bar 27. The inside frame at the mid height thereof consists of jambs 29, 31 and mullion 11. Jambs 29, 31 are made of a rectangular steel tube and filled with concrete. Mullion 11 is made from a rectangular steel tube and filled with hardened concrete containing carbide chips reinforcing steel rebars 33. Installation anchors 34, 34 are equipped with the window unit at both side walls thereof, which are adapted for the use of installation in a wall opening of a detention building.

Figure 4:
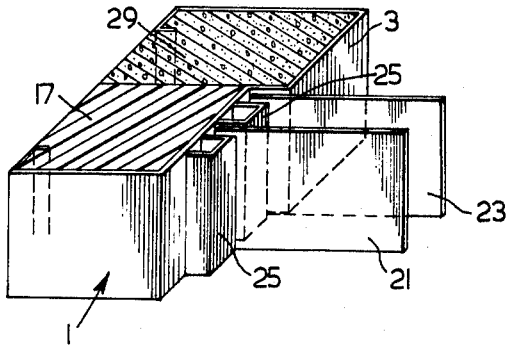
FIG. 4 is a fragmentary horizontal sectional view of a jamb seen from the outside.

In FIG. 4 is shown the fragmentary sectional view of a jamb of the window unit. Due to the structure of the window unit, the identical view is also seen at the sill and head frame of the window unit. Plastic glazing 21, 23 are secured with glass stops 25, 25 extending along and on the jamb 17. Glass stops 25, 25 are constructed of sheet steel on a channel-like shape and mounted to the outside frame with countersunk fastening devices.

Figure 5:
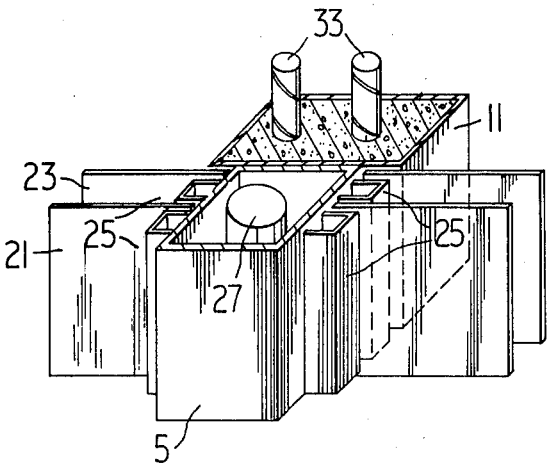
FIGS. 5 and 6 are fragmentary vertical sectional views of the bottom part of the mullion where it intersects with the sill, in two similar embodiments.

FIG. 5 illustrates a fragmentary horizontal sectional view at the mid height of the mullion of the window unit. Rotatable steel bar 27 is pivotally housed on pivot pins 35 (shown in FIGS. 6 and 6*a*) in the outside mullion 5. Two reinforcing steel bars 33 extend through the length of the inside mullion 11. The glazing is secured to the outside mullion in the same manner as employed with regard to the jambs, sill and head frame of the outside frame. The widths of the outside mullion and two adjacent glass stops is identical to those of the inside mullion.

Figure 6:
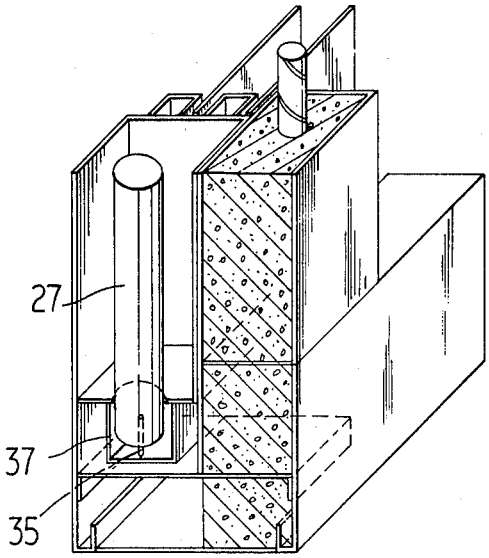

In FIG. 6 there is illustrated the bottom portion of the mullion of the window unit. Rotatable steel bar 27 is provided with a stainless steel pin 35 extending from the bottom end thereof downwardly and resting on stainless steel channel seat 37, thereby enabling free rotation of the rotatable steel bar when the bar is subjected to physical abuse.

FIG. 7 shows the top portion of the mullion of the window unit. Rolling bar 27 extends through a concentric hole 39 provided through the lower web of head frame 9 of the outside frame. The bottom surface of each glass stop is as low as the bottom surface of head frame 15 of the inside frame.

Figure 6A:
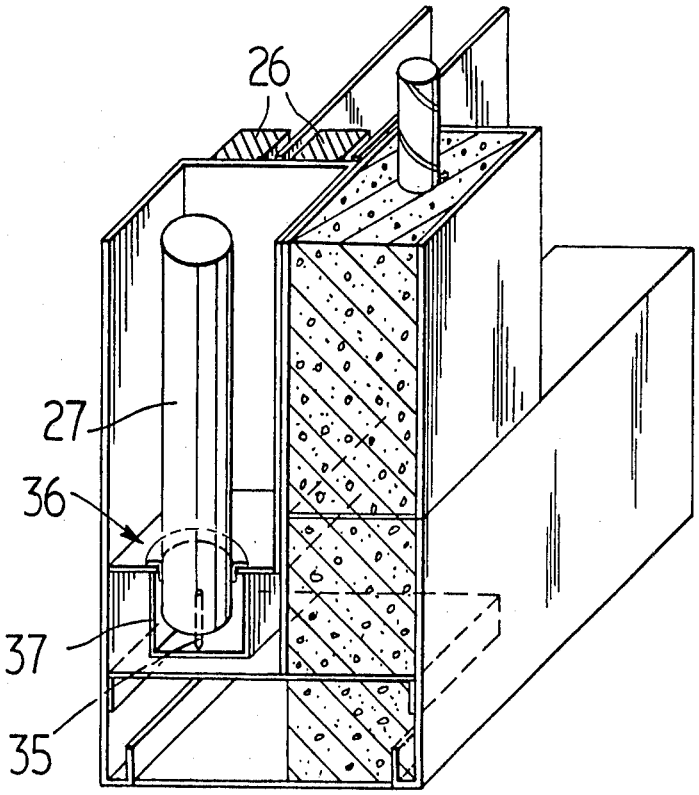

In FIGS. 6*a* and 7*a*, there are illustrated solid-steel bar type glass stops 26, 26 and nylon bushing 36, 38 mounted in the bottom and top holes through which rotatable bar 27 extends.

From the foregoing, it will now be seen that there is herein provided a novel security and aesthetic window unit which is particularly applicable to detention buildings such as prisons, jails, cell blocks, penitentiaries, asylums.

The embodiments of the invention in which an exclusive property or privilege is claimed are defined as follows:

1. A security window unit comprising:

a first frame comprising a first pair of jambs, a first sill and a first head frame, said first pair of jambs, first sill and first head frame each including a rectangular steel channel filled with rigid insulation material, said first frame further comprising at least one first mullion dividing a window opening into sections and including a steel tube housing therein a rotatable bar; and a second frame comprising a pair of second jambs, a second sill and a second head frame, said second jamb, second sill and second head frame each including a steel channel filled with concrete, said second frame further comprising at least one second mullion dividing a window opening into sections having a width no greater than six inches and including a steel tube filled with hardened concrete.

2. The security window unit as claimed in claim 1 wherein said first mullion also contains a longitudinal concrete filled portion.

3. The security window unit as claimed in claim 1, wherein each mullion divides the window opening thus formed into sections, each not more than $5\frac{3}{4}$ inches in width.

4. The security window unit as claimed in claim 1, wherein each of said first and second frames contains more than one mullion.

5. The security window unit as claimed in claim 1, wherein each mullion of said second frame is reinforced with at least one steel reinforcing bar longitudinally extending therethrough.

6. The security window unit as claimed in claim 1, wherein the hardened concrete contains carbide chips.

7. the security window unit as claimed in claim 1, wherein the rigid-insulating material is fiberglass.

8. The security window unit as claimed in claim 1, wherein the rotatable steel bar is pivotally secured with the sill and extends through a concentric circular hole provided through the lower web of the head frame.

9. The security window unit as claimed in claim 8, wherein the rotatable steel bar extends, through a concentric circular hole provided through the upper web of the sill, to a channel seat which is placed between the upper and lower webs of said sill.

10. The security window unit as claimed in claim 8, wherein the concentric circular hole is provided with a bushing.

11. The security window unit as claimed in claim 9, wherein each concentric circular hole is provided with a bushing.

12. The security window unit as claimed in claim 10, wherein the bushing is made of nylon.

13. The security window unit as claimed in claim 1, wherein the bar is round-shaped in latitudinal cross-section.

14. The security window unit as claimed in claim 1, wherein each opening of the first frame is glazed.

15. The security window unit as claimed in claim 1, wherein each opening of the first frame is glazed with two sheets of plastic plates spaced from each other.

16. The security window unit as in claim 15, wherein the spaced two sheets of plastic plates are firmly installed with said first frame by means of sheet steel in a channel like shape which in turn is mounted to the first frame with countersunk devices.

17. The security window unit as in claim 15, wherein the spaced two sheets of plastic plates are firmly installed with said first frame by means of solid steel bars which in turn are mounted to said first frame with countersunk devices.

18. The security window unit as claimed in claim 1, said unit further comprises anchor pieces secured with the jambs of said unit and adapted for the use in installing the unit in the opening of concrete or masonry walls.

19. The security window unit as claimed in claim 1, wherein the rotatable steel bar is made of hardened tool steel and equipped with a stainless steel pin extending from the bottom of said bar.

20. The security window unit as claimed in claim 8 wherein the rotatable steel bar is made of hardened tool steel and equipped with a stainless steel pin extending from the bottom of said bar.

21. The security window unit as in claim 19, wherein said pin is placed on a channel seat.

22. The security window unit as claimed in claim 1, wherein the first frame and the second frame form respectively the outside frame and the inside frame of the window unit when installed in the opening of concrete or masonry walls.

23. The security window unit as claimed in claim 5, wherein the first frame and the second frame form respectively the outside frame and the inside frame of the window unit when installed in the opening of concrete or masonry walls.

24. The security window unit as claimed in claim 7, wherein the first frame and the second frame form respectively the outside frame and the inside frame of the window unit when installed in the opening of concrete or masonry walls.

25. The security window unit as claimed in claim 17, wherin the first frame and the second frame form respectively the outside frame and the inside frame of the window unit when installed in the opening of concrete or masonry walls.

* * * * *